US007196048B2

(12) United States Patent
Zhang et al.

(10) Patent No.: US 7,196,048 B2
(45) **Date of Patent: *Mar. 27, 2007**

(54) FABRIC CARE SYSTEMS FOR PROVIDING ANTI-WRINKLE BENEFITS TO FABRIC

(75) Inventors: Shulin Larry Zhang, West Chester, OH (US); Janet Sue Littig, Liberty Township, OH (US); Arturo Luis Casado-Dominguez, Brussels (BE)

(73) Assignee: The Procter & Gamble Co., Cincinnati, OH (US)

( * ) Notice: Subject to any disclaimer, the term of this patent is extended or adjusted under 35 U.S.C. 154(b) by 15 days.

This patent is subject to a terminal disclaimer.

(21) Appl. No.: 10/896,109

(22) Filed: Jul. 21, 2004

(65) Prior Publication Data

US 2004/0259762 A1 Dec. 23, 2004

Related U.S. Application Data

(62) Division of application No. 10/196,398, filed on Jul. 16, 2002, now Pat. No. 6,818,610.

(60) Provisional application No. 60/352,840, filed on Jan. 30, 2002, provisional application No. 60/308,204, filed on Jul. 27, 2001.

(51) Int. Cl.
*C11D 3/37* (2006.01)

(52) U.S. Cl. ..... 510/527; 510/522

(58) Field of Classification Search ..... None
See application file for complete search history.

(56) References Cited

U.S. PATENT DOCUMENTS

| | | | | |
|---|---|---|---|---|
| 3,861,870 | A | 1/1975 | Edwards et al. | |
| 3,886,075 | A | 5/1975 | Bernadino | |
| 3,974,076 | A | 8/1976 | Wiersema et al. | |
| 4,045,361 | A | 8/1977 | Watt et al. | |
| 4,233,164 | A | 11/1980 | Davis | |
| 4,237,016 | A | 12/1980 | Rudkin et al. | |
| 4,308,151 | A | 12/1981 | Cambre | |
| 4,401,578 | A | 8/1983 | Verbruggen | |
| 4,439,335 | A | 3/1984 | Burns | |
| 4,661,269 | A | 4/1987 | Trinh et al. | |
| 4,800,026 | A | 1/1989 | Coffindaffer et al. | |
| 4,818,242 | A | 4/1989 | Burmeister et al. | |
| 5,417,868 | A | 5/1995 | Turner et al. | |
| 5,474,690 | A | 12/1995 | Wahl et al. | |
| 5,545,350 | A | 8/1996 | Baker et al. | |
| 5,622,925 | A | 4/1997 | DeBuzzaccarini et al. | |
| 5,643,865 | A | 7/1997 | Mermelstein et al. | |
| 5,798,107 | A | 8/1998 | Vogel et al. | |
| 5,807,956 | A | 9/1998 | Czech | |
| 6,083,899 | A | 7/2000 | Baker et al. | |
| 6,211,114 | B1 | 4/2001 | Sivik et al. | |
| 6,515,095 | B1 * | 2/2003 | Omura et al. | 528/38 |
| 6,706,680 | B2 * | 3/2004 | Fender et al. | 510/504 |
| 6,903,061 | B2 * | 6/2005 | Masschelein et al. | 510/330 |

FOREIGN PATENT DOCUMENTS

| | | |
|---|---|---|
| CA | 1102511 | 6/1981 |
| DE | 198553720 A1 | 5/2000 |
| DE | 199 44 416 A1 | 3/2001 |
| EP | 0 300 525 | 1/1989 |
| EP | 472 178 B1 | 5/1995 |
| EP | 1 199 350 A1 | 4/2001 |
| FR | 2 318 268 | 2/1977 |
| WO | WO 02/18528 A1 | 7/1999 |
| WO | WO 99/32539 | 7/1999 |
| WO | WO 00/15746 | 3/2000 |
| WO | WO 01/90285 A1 | 11/2001 |

* cited by examiner

*Primary Examiner*—John R. Hardee
(74) *Attorney, Agent, or Firm*—Kim William Zerby; Steven W. Miller

(57) ABSTRACT

The present invention relates to anti-wrinkle fabric treatment compositions comprising:

a) from about 0.01% to about 20% by weight, of a cationic silicone polymer or copolymer having the formula:

$[CAP]\text{-}Z_m\text{-}[CAP]$ wherein each Z unit comprises at least one secondary, tertiary, or quaternary amino moiety, or mixtures thereof; [CAP] is a backbone termination or truncation unit; m is from 1 to 50.

b) from about 1% to about 30% by weight, of a scavenger effective in scavenging compounds comprising an anionic unit; and c) the balance a carrier system.

In addition, the present invention relates to fabric rinse additive compositions comprising:

a) from about 0.01% to about 20% by weight, of a cationic silicone polymer or copolymer having the formula:

$[CAP]\text{-}Z_m\text{-}[CAP]$ wherein each Z unit comprises at least one secondary, tertiary, or quaternary amino moiety, or mixtures thereof; [CAP] is a backbone termination or truncation unit; m is from 1 to 50.

b) from about 1% to about 30% by weight, a minor component selected from the group consisting of emulsifiers, perfumes, dyes, preservatives or mixtures thereof; and c) the balance a carrier system.

3 Claims, No Drawings

FABRIC CARE SYSTEMS FOR PROVIDING ANTI-WRINKLE BENEFITS TO FABRIC

CROSS-REFERENCE TO RELATED APPLICATIONS

This application is a divisional application of U.S. application Ser. No. 10/196,398, now U.S. Pat. No. 6,818,610, filed on Jul. 16, 2002, which claims the priority benefit under 35 U.S.C. § 119(e) of U.S. Provisional Application Ser. No. 60/352,840 filed on Jan. 30, 2002, and U.S. Provisional Application Ser. No. 60/308,204 filed on Jul. 27, 2001.

FIELD OF THE INVENTION

The present invention relates to fabric care systems that enhance the anti-wrinkle properties of fabric. The systems of the present invention also comprise compositions comprising cationic silicones. The present invention further relates to methods for providing an anti-wrinkle benefit to fabric.

BACKGROUND OF THE INVENTION

Fabric, especially cellulose based fabric, inter alia, cotton, has a propensity to wrinkle either upon drying after the laundry process or when worn. Permanent press finishes have been used to provide a crisp, smooth garment, however, permanent press processes must modify the fabric itself, either by cross linking of the cellulose fiber or by applying a less flexible coating material. The breathability, especially of cotton, is sacrificed if the applied coating or crosslinking fills the interstices of the fiber cells.

For natural fiber, inter alia, cotton, most coatings must be chemically reacted with the fabric fiber itself in order to obtain the desired level of anti-wrinkle properties. This type of treatment also can occur during the synthesis of polyester fabrics as well. To achieve controlled deposition, there must be an affinity for a fabric surface and the ability of a substrate to lie down onto the garment surface is key to achieving and maintaining a smooth fabric surface.

There is, therefore, a long felt need in the art for a fabric treatment system which provides anti-wrinkle benefits to fabric regardless of fabric type, and which does not require chemical bonding of the substrate to the fabric itself.

SUMMARY OF THE INVENTION

The aforementioned needs have been met in that it has been surprisingly discovered that certain cationic silicone compounds when used in combination with materials capable of scavenging compounds having an anionic charge which can affect active deposition onto fabric, together provide anti-wrinkle benefits to fabric. The benefits of the present invention can be delivered by way of a liquid fabric conditioning composition. The cationic silicones of the present invention can be part of a system used to enhance the properties of fabric.

The first aspect of the present invention relates to fabric enhancement compositions comprising:

a) from about 0.01% to about 20% by weight, of a cationic silicone polymer or copolymer having the formula:

$$[CAP]\text{-}Z_m\text{-}[CAP]$$

wherein each Z unit independently has the formula:

$$—(R)_x—W—(R)_x—$$

x is 0 or 1;

W is a siloxane unit having the formula:

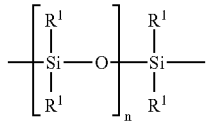

each $R^1$ unit is a $C_1$–$C_{22}$ linear or branched, substituted or unsubstituted hydrocarbyl moiety; n is an index from 1 to 500;

R is a nitrogen atom containing backbone unit having the formula:

$$\text{-}[(L)_y\text{-}(R^2)_y\text{-}(L)_y]\text{-}B\text{-}[(L)_y\text{-}(R^2)_y\text{-}(L)_y]\text{-}$$

B is a unit comprising at least one secondary, tertiary, or quaternary amino moiety, or mixtures thereof; $R^2$ is a coupling unit having the formula:

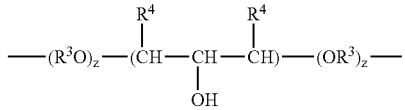

$R^3$ is $C_2$–$C_{12}$ linear or branched alkylene; $R^4$ is hydrogen, or a $C_1$–$C_{22}$ linear or branched, substituted or unsubstituted hydrocarbyl moiety; y is 0 or 1; z is from 0 to 50;

L is a linking unit; [CAP] is a backbone termination or truncation unit; m is from 1 to 50.

b) from about 1% to about 30% by weight, of a scavenger effective in scavenging compounds comprising an anionic unit; and c) the balance a carrier system.

The present invention further relates to a method for providing fabric enhancement and anti-wrinkle benefits to fabric, said method comprising the step of contacting fabric with a rinse-added composition as described herein.

An additional aspect of the present invention relates to a fabric rinse additive composition comprising the cationic silicone polymer and/or copolymer described above. The present invention further relates a method for providing fabric enhancement and anti-wrinkle benefits to fabric, said method comprising the step of contacting fabric with a fabric rinse additive composition as described herein. The present invention relates further still to the use of a fabric rinse additive composition as described herein in conjunction with a fabric softening composition to provide improved fabric softening and anti-wrinkling benefits.

These and other objects, features, and advantages will become apparent to those of ordinary skill in the art from a reading of the following detailed description and the appended claims. All percentages, ratios and proportions herein are by weight, unless otherwise specified. All temperatures are in degrees Celsius (° C.) unless otherwise specified. All documents cited are in relevant part, incorporated herein by reference.

DETAILED DESCRIPTION OF THE INVENTION

The present invention relates to rinse-added fabric enhancement compositions wherein one primary benefit is anti-wrinkling of fabric. This anti-wrinkling benefit is not only present as the fabric emerges from the laundry cycle, but this benefit is sustained while the fabric is worn and can be renewed upon subsequent treatment at the next laundry cycle. The present invention is especially useful when used to provide an anti-wrinkle benefit to articles of manufacture used as garments, inter alia, trousers, blouses, and the like.

This benefit is surprisingly independent of fabric type. This benefit is effective over a wide rang of fabric types because, unlike permanent press treatments, the compounds which provide the benefits do not react with the fabric fibers themselves. The ingredients which comprise the present invention are surprisingly fabric substantive across a range of fabric types (from hydrophobic to hydrophilic fibers) and are able to modify the properties of said fabric without the loss of other desirable fabric properties.

Definitions

For the purposes of the present invention the term "hydrocarbyl" is defined herein as "any unit which comprises carbon and hydrogen atoms, whether linear, branched, cyclic, acyclic, and regardless of how many of the hydrogen atoms are substituted for with a suitable "substituted" unit as defined herein below." Non-limiting examples of "hydrocarbyl" units include methyl, benzyl, 6-hydroxyoctanyl, m-chlorophenyl, 2-(N-methylamino)propyl, and the like.

The term "substituted" is used throughout the specification and for the purposes of the present invention the term "substituted" is defined as "replacement of a hydrogen atom, two hydrogen atoms, or three hydrogen atoms from a carbon atom to form a moiety, or the replacement of hydrogen atoms from adjacent carbon atoms to form a moiety." For example, a substituted unit that requires a single hydrogen atom replacement includes halogen, hydroxyl, and the like. A two hydrogen atom replacement includes carbonyl, oximino, and the like. Three hydrogen replacement includes cyano, and the like. The term substituted is used throughout the present specification to indicate that a moiety, inter alia, aromatic ring, alkyl chain, can have one or more of the hydrogen atoms replaced by a substituent. For example, 4-hydroxyphenyl is a "substituted aromatic carbocyclic ring", and 3-guanidinopropyl is a "substituted $C_3$ alkyl unit."

The following are non-limiting examples of moieties, which can replace hydrogen atoms on carbon to form a "substituted hydrocarbyl" unit:

i) —$NHCOR^{30}$;
ii) —$COR^{30}$;
iii) —$COOR^{30}$;
iv) —$COCH{=}CH_2$;
v) —$C({=}NH)NH_2$;
vi) —$N(R^{30})_2$;
vii) —$NHC_6H_5$;
viii) ={CHC6$H_5$;
ix) —$CON(R^{30})_2$;
x) —$CONHNH_2$;
xi) —NHCN;
xii) —OCN;
xiii) —CN;
xiv) F, Cl, Br, I, and mixtures thereof;
xv) ={O};
xvi) —$OR^{30}$;
xvii) —NHCHO;
xviii) —OH;
xix) —$NHN(R^{30})_2$;
xx) ={$NR^{30}$};
xxi) ={$NOR^{30}$};
xxii) —$NHOR^{30}$;
xxiii) —CNO;
xxiv) —NCS;
xxv) ={$C(R^{30})_2$};
xxvi) —$SO_3M$;
xxvii) —$OSO_3M$;
xxviii) —SCN;
xxix) —$P(O)H_2$;
xxx) —$PO_2$;
xxxi) —$P(O)(OH)_2$;
xxxii) —$SO_2NH_2$;
xxxiii) —$SO_2R^{30}$;
xxxiv) —$NO_2$;
xxxv) —$CF_3$, —$CCl_3$, —$CBr_3$;
xxxvi) and mixtures thereof;

wherein $R^{30}$ is hydrogen, $C_1$–$C_{20}$ linear or branched alkyl, $C_6$–$C_{20}$ aryl, $C_7$–$C_{20}$ alkylenearyl, and mixtures thereof; M is hydrogen, or a salt forming cation. Suitable salt forming cations include, sodium, lithium, potassium, calcium, magnesium, ammonium, and the like. Non-limiting examples of an alkylenearyl unit include benzyl, 2-phenylethyl, 3-phenylpropyl, 2-phenylpropyl.

Cationic Silicone Polymers and Copolymers

The compositions of the present invention comprise one or more cationic silicone polymers or copolymers. These compounds have the formula:

$$[CAP]\text{-}Z_m\text{-}[CAP]$$

wherein each unit Z is a silicone comprising unit. Each Z unit can be the same of different from other Z units present in the molecule, however, one aspect of the present invention relates to embodiments wherein all Z units have a uniform composition. However, in this aspect of the invention, especially when the resulting compounds are polymeric, there will be a variation in the exact structure of the Z units primarily due to the variation in the chain length of the unit. Other aspects of the present invention, as discussed herein below comprise copolymers wherein more than one type or class of Z unit is present.

Z units have the formula:

$$—(R)_x—W—(R)_x—$$

wherein the index x is 0 or 1; W is a siloxane unit having the formula:

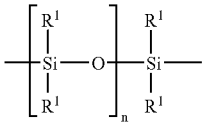

wherein each $R^1$ unit is a $C_1$–$C_{22}$ linear or branched, substituted or unsubstituted hydrocarbyl moiety; n is an index from 1 to 500. In one embodiment of the present invention $R^1$ is a unit selected from the group consisting of:

i) $C_1$–$C_{22}$ linear or branched alkyl;

ii) $C_3$–$C_{22}$ cycloalkyl;

iii) $C_6$–$C_{22}$ aryl;

iv) $C_7$–$C_{22}$ alkylenearyl;

v) $C_1$–$C_{22}$ linear or branched fluoroalkyl;

vi) $C_2$–$C_{22}$ linear or branched alkenyl;

vii) $C_1$–$C_{22}$ linear or branched alkoxy; and viii) mixtures thereof.

Another aspect of the present invention provides $R^1$ units which are all identical, for example, each $R^1$ unit is methyl. Siloxane units wherein each $R^1$ unit is methyl has the general formula:

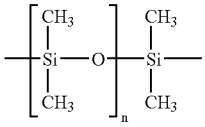

wherein the index n will vary depending upon the choice of the formulator. In one embodiment of the present invention, a single siloxane unit is used in a Z unit, wherein n is 1.

R is a nitrogen atom containing backbone unit having the formula:

$$-[(L)_y-(R^2)_y-(L)_y]-B-[(L)_y-(R^2)_y-(L)_y]-$$

wherein B is a backbone unit comprising at least one amino unit, said amino units selected from the group consisting of secondary amino units, tertiary amino units, quaternary amino units, and mixtures thereof having the formula:

i)

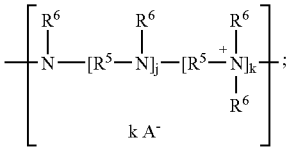

-continued ii)

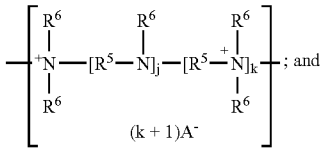

iii) mixtures thereof wherein each $R^5$ is independently:

i) $C_2$–$C_{12}$ linear or branched alkylene;

ii) $C_6$–$C_{12}$ arylene;

iii) $C_7$–$C_{22}$ alkylenearylene;

iv) an alkyleneoxy unit having the formula:

$$—(R^{11}O)_a(R^{11}O)_b(R^{11}O)_c(R^{11})—$$

wherein $R^{11}$ is a $C_2$–$C_{12}$ alkylene unit, the indices a, b, and c are from 0 to 100;

v) a linking unit derived from a dibasic acid, glycidyl ether, or mixtures thereof having the formula:

$$—[C(O)]_d(R^{11}O)_a(R^{12})_e[C(O)]_d—$$

wherein $R^{12}$ is $C_1$–$C_{20}$ linear or branched alkylene; $—CH_2CHOHCH_2—$, and mixtures thereof, a is from 0 to 100, d is 0 or 1, e is from 0 to 20;

each $R^6$ is independently:

i) hydrogen;

ii) $C_1$–$C_{22}$ linear or branched, substituted or unsubstituted hydrocarbyl moiety;

iii) two $R^6$ units from the same nitrogen atom can be taken together to form an aromatic or non-aromatic, quaternized or non-quaternized heterocyclic unit;

iv) two R units each from adjacent nitrogen atoms can be taken together to form an aromatic or non-aromatic, quaternized or non-quaternized heterocyclic unit;

v) one R unit can be taken together with a $R^5$ unit to form an aromatic or non-aromatic, quaternized or non-quaternized heterocyclic unit;

vi) and mixtures thereof;

A is a water soluble anion; j is from 0 to 6, k is from 0 to 1.

Non-limiting examples of B units include:

i)

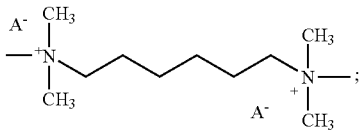

ii)

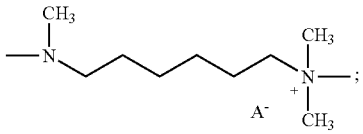

iii)

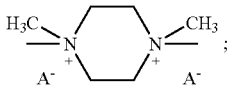

-continued iv)

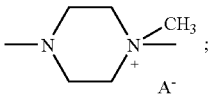

v)

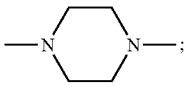

vi)

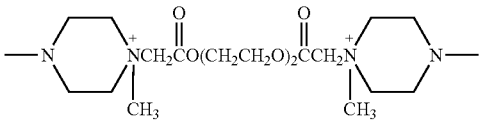

vii)

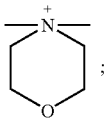

viii) and mixtures thereof.

Other embodiments include amino backbone units which are derived from amino acids, for example, W units, a portion of which includes a moieties having the formula:

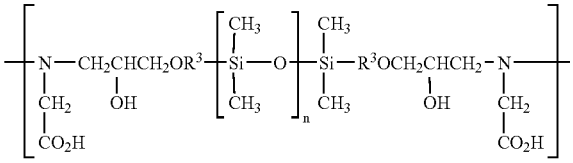

$R^2$ is a coupling unit having the formula:

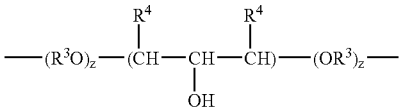

$R^3$ is $C_2$–$C_{12}$ linear or branched alkylene; $R^4$ is hydrogen, or a $C_1$–$C_{22}$ linear or branched, substituted or unsubstituted hydrocarbyl moiety. In one embodiment of the present invention, $R^3$ is n-propylene and $R^4$ are each hydrogen. The index z has the value 0 or 1. The $R^2$ unit can be typically formed by the reaction of an epoxy unit having the general formula:

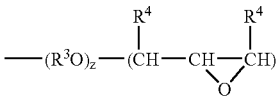

and a unit capable of opening the epoxy ring.

One embodiment of the present invention utilizes the $R^2$ unit having the formula:

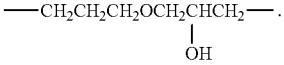

L is a linking unit which is capable of providing a link between the amino containing backbone unit B and other units comprising the backbone. Linking units can be any suitable combination of atoms except highly reactive or unstable combinations, non-limiting examples of which include, O—O bonds, N—O bonds, and the like.

Non-limiting examples of suitable linking units includes units selected from the group consisting of:

i) $—[C(R^7)_2]_p—$; wherein p is from 1 to 22;

ii) $—[C(R^7)_2]_p(CH{=}CH)_q—$; wherein p is from 0 to 12; q is from 1 to 6;

iii) —C(X)—;

iv) —OC(X)—;

v) —C(X)O—;

vi) $—[C(R^7)_2]_qC(X)X(R^8O)_p—$; wherein p is from 0 to 12; q is from 1 to 6;

vii) $—(OR^8)_pXC(X)[C(R^7)_2]_q—$; wherein p is from 0 to 12; q is from 1 to 6;

viii) $—C(X)NR^7—$;

ix) $—C(X)R^8C(X)—$;

x) $—C(X)NR^7C(X)—$;

xi) $—C(X)NR^7R^8NR^7C(X)—$;

xii) $—NR^7C(X)—$;

xiii) $—NR^7C(X)NR^7—$;

xiv) $—NR^7C(X)R^8NR^7$;

xv) $—NR^7R^8C(X)NR^7—$;

xvi) $—NR^7C(X)R^8C(X)O—$;

xvii) $—OC(X)R^8C(X)NR^7—$;

xviii) $—NR^7C(X)R^8C(X)O—$;

xix) $—NR^7C(X)NR^7R^8—$;

xx) $—R^8NR^7C(X)NR^7—$;

xxi) $—NR^7C(X)NR^7R^8—$;

xxii) $—R^8NR^7C(X)NR^7R^8—$;

xxiii) $—NR^7—$;

xxiv) $—R^8NR^7—$;

xxv) $—NR^7R^8—$;

xxvi) $—NR^7{=}N—$;

xxvii) $—NR^7NR^7—$ xxviii) $—OR^8—$;

xxix) $—R^8O—$;

xxx) $—(R^8)_uC(X)(R^8)_u—$;

xxxi) $—(R^8)_uOC(O)(R^8)_u—$;

xxxii) $—(R^8)_uC(O)O(R^8)_u—$;

xxxiii) $—(R^8)_uOC(O)O(R^8)_u—$;

wherein $R^7$ is hydrogen, $C_1$–$C_{22}$ linear or branched alkyl; $C_1$–$C_{22}$ cycloalkyl; $C_1$–$C_{22}$ linear or branched fluoroalkyl; $C_2$–$C_{22}$ linear or branched alkenyl; $C_6$–$C_{22}$ aryl; $C_7$–$C_{22}$ alkylenearyl; and mixtures thereof; $R^8$ is $C_2$–$C_{20}$ linear or branched, substituted or unsubstituted alkylene; $C_7$–$C_{20}$ alkylenearylene; $C_6$–$C_{20}$ substituted or unsubstituted arylene; X is oxygen, sulfur, $=NR^7$, and mixtures thereof; u is 0 or 1.

The index y is 0 or 1.

One aspect of the present invention relates to embodiments wherein an α-halo carboxylic acid ester, typically an α-chloroacetic acid polyoxyethylene ester, is used as a linking unit, said units having the formula:

$—[CH_2]_qC(O)O(CH_2CH_2O)_p—$ or $—(OCH_2CH_2)_pOC(O)[CH_2]_q—$ wherein p is from 1 to 12, specific embodiments of which include q is equal to 1, while p is equal to 3, 6, and 8 respectively.

[CAP]—unit are units which end, terminate, or truncate the polymer, copolymer, or oligomeric chain. The term "truncate" signifies the fact the formulator may provide a specific end capping unit [CAP] or may allow the chain to terminate from the lack of reactive materials (control of stoichiometry) or by quenching. In addition, it will be recognized by the formulator that the chain elongation steps may be truncated by solvolysis or by reaction with an impurity. For example, the formulator may desire the polymers of the present invention to continue adding units by a reaction having the scheme:

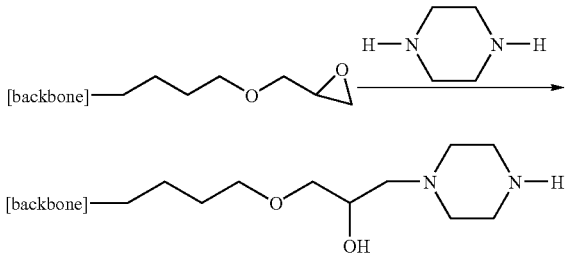

However, an impurity having a nucleophilic center, may react to truncate the chain prematurely, an non-limiting example of which is depicted by the scheme:

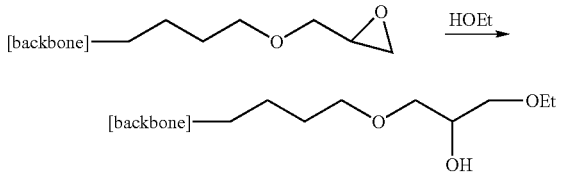

The formulator may also provide specific capping units. One embodiment of the present invention provides [CAP] units selected from the group consisting of:

i)

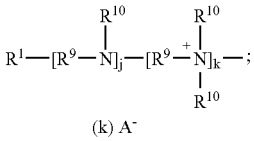

-continued ii)

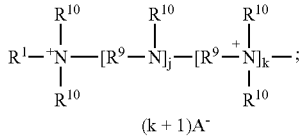

iii)

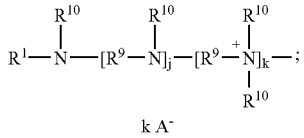

iv)

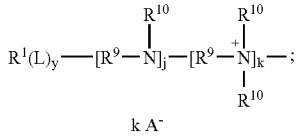

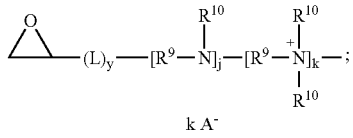

v)

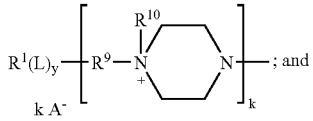

vi) mixtures thereof;

wherein $R^1$ is the same as defined herein above, each $R^9$ is independently $C_1$–$C_{12}$ linear or branched alkylene, $C_6$–$C_{12}$ arylene, $C_7$–$C_{22}$ alkylenearylene; $R^{10}$ is hydrogen, or a $C_1$–$C_{22}$ linear or branched, substituted or unsubstituted hydrocarbyl moiety; two $R^{10}$ units from the same nitrogen atom, two $R^{10}$ units each from adjacent nitrogen atoms, or one $R^{10}$ unit can be taken together with a $R^5$ unit or an $R^1$ unit to form an aromatic or non-aromatic, quaternized or non-quaternized heterocyclic unit, and mixtures thereof; A is a water soluble anion; j is from 0 to 6, k is from 0 to 1.

Another aspect of the present invention provides for W units as capping units, for example, a polymer having the formula:

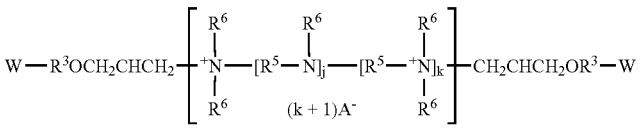

a non-limiting example of which is a polymer having the formula:

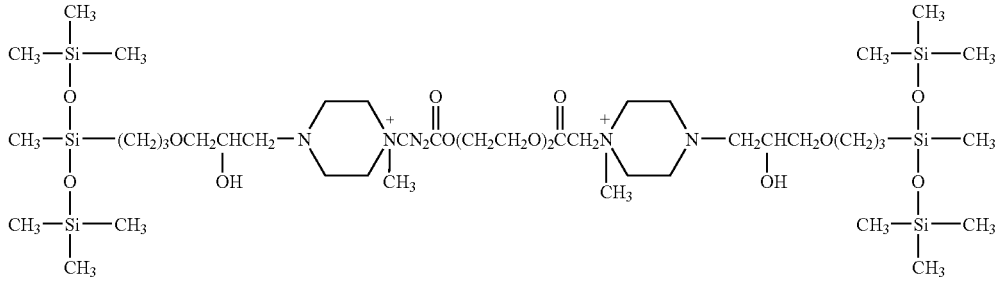

A non-limiting example of a capping unit includes:

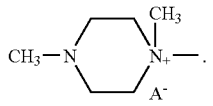

The backbones of the present invention may comprise a quaternary ammonium unit and therefore the formulator will provide a counter ion, A. These counter ions can be any suitable water soluble anion. In order to formulate the polymeric materials of the present invention, it may be necessary to protonate, through the use of acids, one or more backbone secondary amino units. The secondary amino units (protonated backbone nitrogens) may have for their counter ions any number of suitable organic acids or combinations thereof. Non-limiting examples include acetic acid, tri-basic citric acid, mono-basic citric acid, 50/50 acetic/lauric acids, and the like.

One aspect of the present invention relates to cationic silicone copolymers having two different nitrogen containing B units, for example the oligomer having the formula:

TABLE I-continued

| No. | m | n | a + c | b |
|---|---|---|---|---|
| 3 | 4 | 82 | 0 | 0 |
| 4 | 4 | 82 | 6 | 38 |
| 5 | 9 | 82 | 6 | 38 |
| 6 | 8 | 82 | 6 | 38 |
| 7 | 4 | 82 | 3 | 9 |
| 8 | 3.5 | 82 | 3 | 9 |
| 9 | 1 | 82 | 3 | 9 |
| 10 | 0.125 | 82 | 3 | 9 |
| 11 | 4 | 111 | 6 | 38 |
| 12 | 4 | 111 | 3 | 9 |
| 13 | 8 | 111 | 6 | 38 |
| 14 | 8 | 130 | 6 | 38 |
| 15 | 4 | 130 | 3 | 9 |
| 16 | 8 | 130 | 68 | 0 |
| 17 | 4 | 160 | 3 | 9 |
| 18 | 8 | 160 | 6 | 38 |
| 19 | 4 | 226 | 3 | 9 |

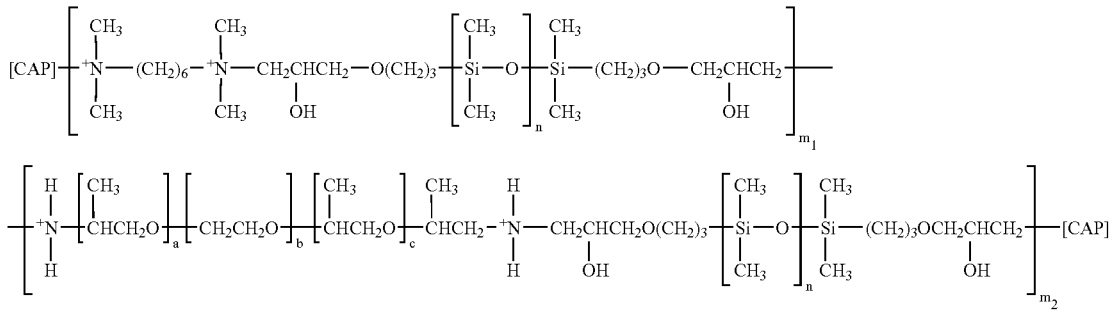

The following table illustrates non-limiting examples of embodiments of this aspect of the present invention, where $m_1$=m and $m_2$=1.

TABLE I

| No. | m | n | a + c | b |
|---|---|---|---|---|
| 1 | 4 | 43 | 0 | 0 |
| 2 | 4 | 43 | 6 | 38 |

For the above examples in Table I, the secondary amino units (protonated backbone nitrogens) have for their counter ions any number of suitable organic acids or combinations thereof. Non-limiting examples include acetic acid, tri-basic citric acid, mono-basic citric acid, 50/50 acetic/lauric acids, and the like.

A further aspect of the present invention relates an embodiment having the formula:

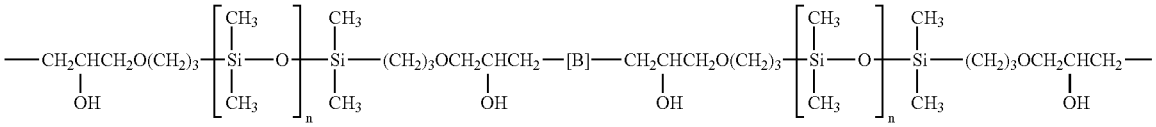

wherein B is selected from the group consisting of:

i)

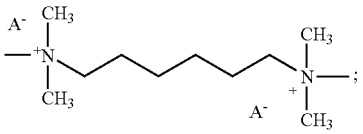

ii)

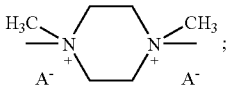

iii)

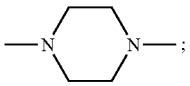

iv)

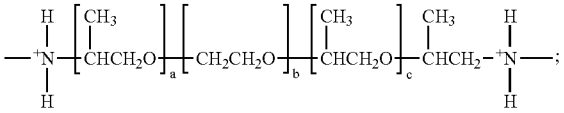

wherein n has an average value of from 35 to 50, in two embodiments, n is 45 and 46 respectively, whereas in other embodiments n has the value of from 100 to 110, in one specific embodiment n is 107, the indices a, b, and c are such that (a+c) is from 0 to 20 and b is from 1 to 200.

Another aspect of the present invention relates to compositions which comprise cationic polymers which are formed by a process comprising the steps of:

A) reacting one equivalent of a diamine having the formula:

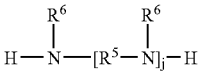

wherein each $R^5$ is independently $C_2$–$C_{12}$ linear or branched alkylene, $C_6$–$C_{12}$ arylene, $C_7$–$C_{22}$ alkylenearylene, an alkyleneoxy unit $—(R^{11}O)_a(R^{11}O)_b(R^{11}O)_c(R^{11})—$, wherein $R^{11}$ is a $C_2$–$C_{12}$ alkylene unit, the indices a, b, and c are from 0 to 100; $R^6$ is hydrogen, or a $C_1$–$C_{22}$ linear or branched, substituted or unsubstituted hydrocarbyl moiety; two $R^6$ units from the same nitrogen atom, two $R^6$ units each from adjacent nitrogen atoms, or one $R^6$ unit can be taken together with a $R^5$ unit to form an aromatic or non-aromatic, quaternized or non-quaternized heterocyclic unit, and mixtures thereof; with one equivalent of an epoxide having the formula:

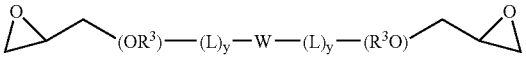

wherein L is a linking unit; W is a siloxane unit having the formula:

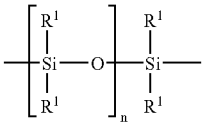

each $R^1$ unit is a $C_1$–$C_{22}$ linear or branched, substituted or unsubstituted hydrocarbyl moiety; n is an index from 1 to 500; $R^3$ is $C_2$–$C_{12}$ linear or branched alkylene; y is 0 or 1; to form a cationic silicone polymer comprising one or more amino units, said polymer comprising units having the formula:

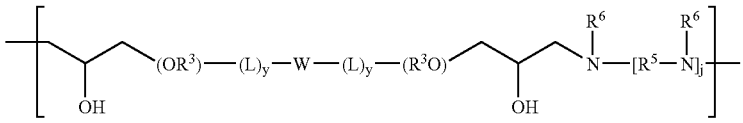

B) optionally reacting said cationic silicone polymer with one or more equivalents of a quaternizing agent thereby quaternizing one or more of said amino units.

The following are non-limiting examples of processes for making the cationic polymers of the present invention.

EXAMPLE 1

The epoxysiloxane having the formula:

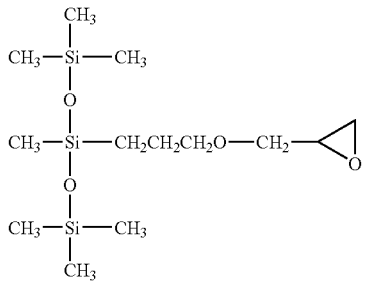

(33.7 g, 0.1 mol) and N-methylpiperizine are combined in isopropanol (40 mL) and refluxed for 7 hours after which the solvent is removed in vacuo to afford in nearly quantitative yield a an aminosiloxane having the formula:

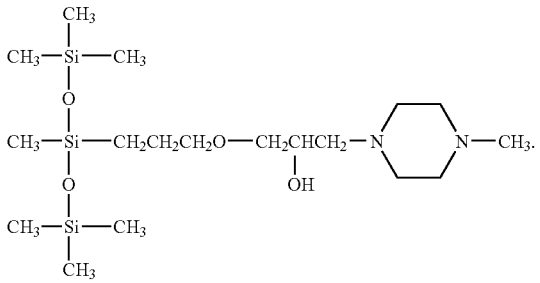

Propargyl alcohol (497 g, 8.87 mol) was stirred under nitrogen at room temperature while over the period of 1 hour; α-chloroacetyl chloride (955 g, 8.45 mole) is added dropwise. During the addition the temperature rises to 60° C. with intense formation of HCl gas. The mixture darkens and is heated for 1 hour at 130° C. Fractional distillation yields 891 g of propargyl α-chloroacetate (boiling point 179–181° C.).

Propargyl α-chloroacetate (26.5 g, 0.2 mole) and Lamoreaux supported catalyst (44 mg) containing 3.43% Pt, according to U.S. Pat. No. 3,220,972 are combined under nitrogen at room temperature. Over 30 minutes 1,1,1,3,5,5,5-heptamethyl trisiloxane is added ant the temperature raised to 60° C. then finally heated to 100° C. for 4 hours.

The distillate boiling up to 120° C. at 2 hPa was removed to yield a yellowish liquid (64.5 g) having the formula:

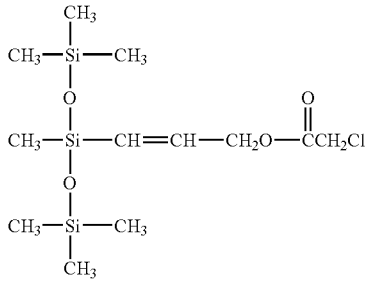

having a purity of 85%.

The piperidine siloxane from above (21.8 g, 0.05 mol) and the chloro ester siloxane (17.7 g, 0.05 mol) are suspended under nitrogen atmosphere in methyl propyl ketone (50 mL) and refluxed for 6 hours. Subsequently the impurities boiling up to 100° C. at 4 hPa were removed to yield 35.7 g of a brown residue having the formula:

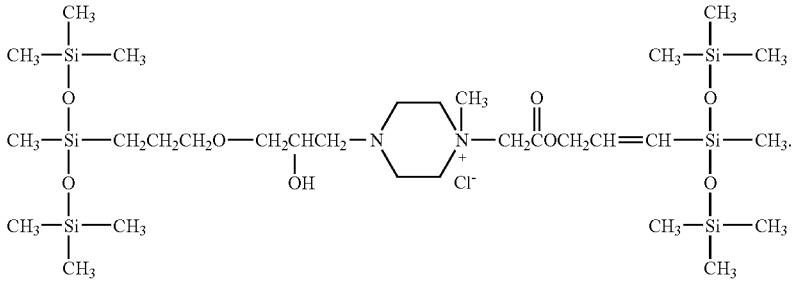

EXAMPLE 2

An epoxy siloxane (211.1 g, 0.15 mol) having the formula:

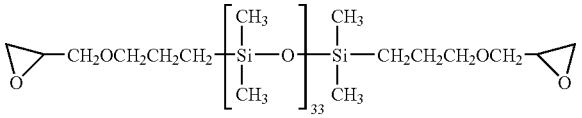

and N-methylpiperazine (15.2 g, 0.15 mol) are combined in isopropanol (225 mL) and heated to 90° C. for 4 hours to form an α,ω-aminosiloxane. The solvent is removed by distillation to yield 217 g of a clear product.

To a polyethylene glycol having an average molecular weight of 300 g/mol (an average of 6.4 ethyleneoxy units per molecule) (150 g, 1 mol eq. of —OH units) under nitrogen atmosphere is added over 30 minutes 3-chloropropionic acid chloride (152.4 g, 1.2 mol). The temperature rises to 70° C. and a profuse liberation of HCl gas ensues. The reaction is continued for 30 minutes at 120° C. after which the impurities boiling up to 120° C. at 20 hPa are removed to yield the compound having the formula:

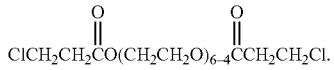

The α,ω-aminosiloxane (19.61 g, 6.5 mmol) and the α,ω-chloropropionic glycol ester (3.12 g, 6.5 mmol) are combined under nitrogen atmosphere in isopropanol (50 mL) and allowed to reflux for 12 hours. Then the impurities boiling up to 70° C. at 20 hPa are removed to yield 21.6 g of an compound having the formula:

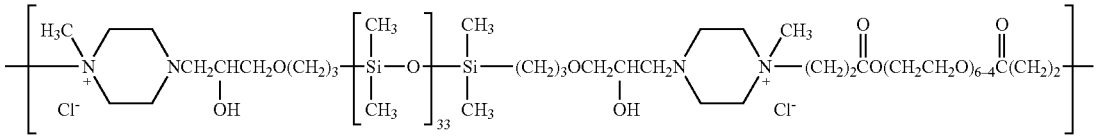

EXAMPLE 3

An epoxy siloxane (181.3 g, 0.5 mol) having the formula:

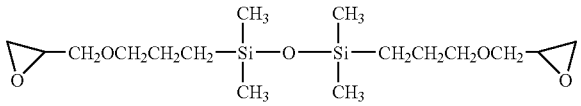

is reacted with N-methylpiperazine (101.2 g, 1 mol) in isopropanol (100 mL). The impurities are distilled off up too 100° C. at 20 hPa to yield a light brown clear residue of 276 g of an α,ω-aminosiloxane. The α,ω-aminosiloxane (6.2 g, 11 mmol) and the α,ω-aminosiloxane from Example B (33.21 g, 11 mmol) are combined with the α,ω-chloropropionic glycol ester from Example B (10.59 g, 22 mmol) and suspended in isopropanol (50 mL) under nitrogen atmosphere and refluxed for 10 hours. The solvent and materials boiling up to 40° C. at 20 hPa are removed to afford 48.7 g of a brown waxy compound having the average formula:

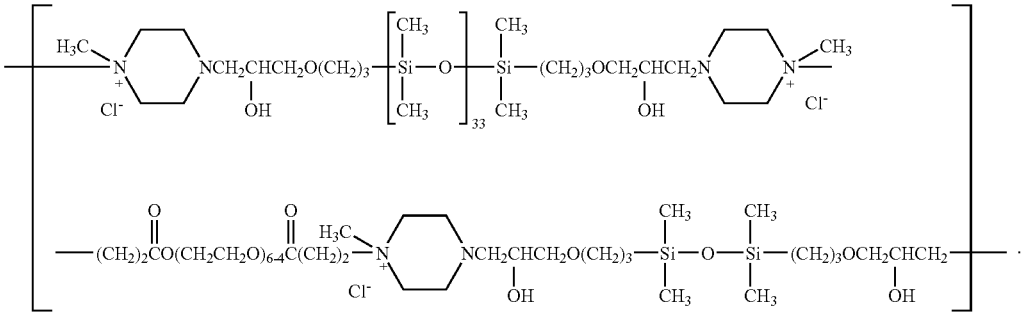

Anionic Scavengers

The second element of the compositions of the present invention relates to compounds which are capable of serving as anionic species scavengers.

One aspect of the present invention relates to anionic scavengers which are ester and amide tertiary amines having the formula:

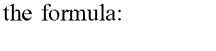

and mono-quaternary ammonium cationic compounds having the formula:

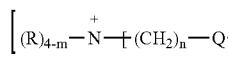

and mixtures thereof, wherein each R is independently $C_1$–$C_6$ alkyl, $C_1$–$C_6$ hydroxyalkyl, benzyl, and mixtures thereof; $R^1$ is preferably $C_{11}$–$C_{22}$ linear alkyl, $C_{11}$–$C_{22}$ branched alkyl, $C_{11}$–$C_{22}$ linear alkenyl, $C_{11}$–$C_{22}$ branched alkenyl, and mixtures thereof; Q is a carbonyl moiety independently selected from the units having the formula:

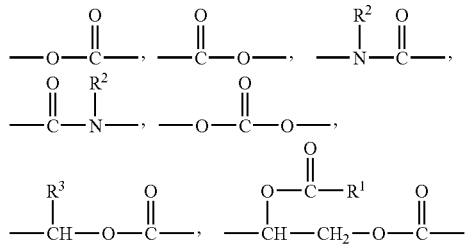

wherein $R^2$ is hydrogen, $C_1$–$C_4$ alkyl, preferably hydrogen; $R^3$ is $C_1$–$C_4$ alkyl, preferably hydrogen or methyl; preferably Q has the formula:

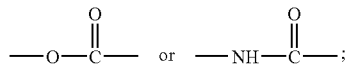

X is a scavenger compatible anion, preferably the anion of a strong acid, for example, chloride, bromide, methylsulfate, ethylsulfate, sulfate, nitrate and mixtures thereof, more preferably chloride and methyl sulfate. The anion can also, but less preferably, carry a double charge, in which case X represents half a group. The index m has a value of from 1 to 3; the index n has a value of from 1 to 4, preferably 2 or 3, more preferably 2.

One embodiment of the present invention provides for amines and quaternized amines having two or more different values for the index n per molecule, for example, a softener active prepared from the starting amine methyl(3-aminopropyl)(2-hydroxyethyl)amine.

One embodiment of this aspect of the present invention relates to anionic scavengers having the formula:

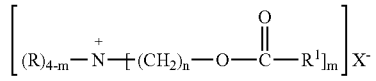

wherein the unit having the formula:

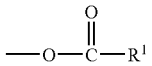

is a fatty acyl moiety. Suitable fatty acyl moieties are derived from sources of triglycerides including tallow, vegetable oils and/or partially hydrogenated vegetable oils including inter alia canola oil, safflower oil, peanut oil, sunflower oil, corn oil, soybean oil, tall oil, rice bran oil. One specific range of embodiments relate to esters having the index m is equal to 2.

One embodiment of the present invention provides esters comprising $R^1$ units which have at least about 3%, in another embodiment at least about 5%, and in yet another embodiment at least about 10% $C_{11}$–$C_{22}$ alkenyl moieties. Another embodiment comprises at least about 15% $C_{11}$–$C_{22}$ alkenyl moieties, including polyalkenyl (polyunsaturated) units inter alia oleic, linoleic, linolenic.

The following are specific embodiments of the diester or diamide comprising mono-amine/mono-quaterary ammonium aspect of the present invention.

- N,N-di(tallowyl-oxygethyl)-N,N-dimethyl ammonium chloride;
- N,N-di(canolyl-oxy-ethyl)-N,N-dimethyl ammonium chloride;
- N,N-di(tallowyl-oxy-ethyl)-N-methyl, N-(2-hydroxyethyl) ammonium methyl sulfate;
- N,N-di(canolyl-oxy-ethyl)-N-methyl, N-(2-hydroxyethyl) ammonium methyl sulfate;
- N,N-di(tallowylamidoethyl)-N-methyl, N-(2-hydroxyethyl) ammonium methyl sulfate;
- N,N-di(2-tallowyloxy-2-oxo-ethyl)-N,N-dimethyl ammonium chloride;
- N,N-di(2-canolyloxy-2-oxo-ethyl)-N,N-dimethyl ammonium chloride;
- N,N-di(2-tallowyloxyethylcarbonyloxyethyl)-N,N-dimethyl ammonium chloride;
- N,N-di(2-canolyloxyethylcarbonyloxyethyl)-N,N-dimethyl ammonium chloride;
- N-(2-tallowoyloxy-2-ethyl)-N-(2-tallowyloxy-2-oxo-ethyl)-N,N-dimethyl ammonium chloride;
- N-(2-canolyloxy-2-ethyl)-N-(2-canolyloxy-2-oxo-ethyl)-N,N-dimethyl ammonium chloride;
- N,N,N-tri(tallowyl-oxy-ethyl)-N-methyl ammonium chloride;
- N,N,N-tri(canolyl-oxy-ethyl)-N-methyl ammonium chloride;
- N-(2-tallowyloxy-2-oxoethyl)-N-(tallowyl)-N,N-dimethyl ammonium chloride;
- N-(2-canolyloxy-2-oxoethyl)-N-(canolyl)-N,N-dimethyl ammonium chloride;
- 1,2-ditallowyloxy-3-N,N,N-trimethylammoniopropane chloride; and
- 1,2-dicanolyloxy-3-N,N,N-trimethylammoniopropane chloride;

and mixtures of the above actives.

Additional amino/quaternary ammonium compounds useful herein as anionic scavengers are described in U.S. Pat. No. 5,643,865 Mermelstein et al., issued Jul. 1, 1997; U.S. Pat. No. 5,622,925 de Buzzaccarini et al., issued Apr. 22, 1997; U.S. Pat. No. 5,545,350 Baker et al., issued Aug. 13, 1996; U.S. Pat. No. 5,474,690 Wahl et al., issued Dec. 12, 1995; U.S. Pat. No. 5,417,868 Turner et al., issued Jan. 27, 1994; U.S. Pat. No. 4,661,269 Trinh et al., issued Apr. 28, 1987; U.S. Pat. No. 4,439,335 Burns, issued Mar. 27, 1984; U.S. Pat. No. 4,401,578 Verbruggen, issued Aug. 30, 1983; U.S. Pat. No. 4,308,151 Cambre, issued Dec. 29, 1981; U.S. Pat. No. 4,237,016 Rudkin et al., issued Oct. 27, 1978; U.S. Pat. No. 4,233,164 Davis, issued Nov. 11, 1980; U.S. Pat. No. 4,045,361 Watt et al., issued Aug. 30, 1977; U.S. Pat. No. 3,974,076 Wiersema et al., issued Aug. 10, 1976; U.S. Pat. No. 3,886,075 Bernadino, issued May 6, 1975; U.S. Pat. No. 3,861,870 Edwards et al., issued Jan. 21, 1975; and European Patent Application publication No. 472,178, by Yamamura et al., all of said documents being incorporated herein by reference.

Another aspect of the present invention relates to anionic scavengers which are quaternary ammonium compounds having the formula:

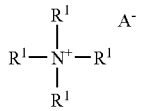

having a suitable water soluble counter ion, A, wherein each $R^1$ is independently $C_1$–$C_{22}$ linear or branched alkyl, $C_2$–$C_{22}$ linear or branched alkenyl, and mixtures thereof. In one embodiment, two $R^1$ units are $C_1$–$C_4$ linear alkyl, an example of which is dimethylditallow ammonium chloride (DTDMAC) wherein the term "tallow" refers to the source of said alkyl units.

Another aspect of the present invention relates to anionic scavengers which are an admixture of di-amino compounds which results from a process comprising the steps of:

i) reacting one equivalent of a diamine having the formula:

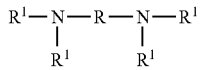

wherein R is $C_2$–$C_{12}$ alkylene; each $R^1$ is independently hydrogen, $C_1$–$C_6$ alkyl, a unit having the formula:

$—R^2\text{-}Z$ wherein $R^2$ is $C_2$–$C_6$ linear or branched alkylene, $C_2$–$C_6$ linear or branched hydroxy substituted alkylene, $C_2$–$C_6$ linear or branched amino substituted alkylene, and mixtures thereof; Z is hydrogen, $—OR^5$, $—N(R^5)_2$, and mixtures thereof; wherein $R^5$ is hydrogen, $C_1$–$C_6$ alkyl, and mixtures thereof; with from about 0.1 equivalent to about 8 equivalents of an acylating unit to form an acylated di-amino admixture; and ii) reacting said acylated di-amino admixture with from 0.1 equivalents to 2 equivalents of a quaternizing agent to form said anionic scavenger system.

The compounds which relate to this aspect of the anionic scavengers is disclosed in U.S. Pat. No. 6,211,140 Sivik et al., issued Apr. 3, 2001 included herein by reference.

Another aspect of the present invention relates to anionic scavenger which are polyamines selected from:

i) linear polyamines having the formula:

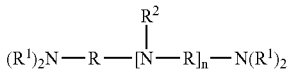

wherein R is ethylene, 1,2-propylene, 1,3-propylene, and mixtures thereof; $R^1$ is hydrogen, $C_1$–$C_2$ alkyl, alkyleneoxy having the formula:

$—(R^3O)—R^4$ wherein $R^3$ is ethylene, 1,2-propylene, 1,2-butylene, or mixtures thereof, $R^4$ is hydrogen, $C_1$–$C_4$ alkyl, or mixtures thereof; and mixtures thereof; $R^2$ is hydrogen, $R^1$, $—RN(R^1)_2$, and mixtures thereof; n is 1 or 2;

ii) cyclic polyamines having the formula:

R-L-R wherein L is a linking unit, said linking unit comprising a ring having at least 2 nitrogen atoms; R is hydrogen, $—(CH_2)_kN(R^1)_2$, and mixtures thereof, wherein $R^1$ is hydrogen, $C_1$–$C_2$ alkyl, alkyleneoxy having the formula:

$—(R^3O)—R^4$ wherein each $R^3$ is independently ethylene, 1,2-propylene, 1,2-butylene, or mixtures thereof, $R^4$ is hydrogen, $C_1$–$C_4$ alkyl, or mixtures thereof; and mixtures thereof; each index k is independently has the value from 2 to 4;

iii) and mixtures thereof.

A detailed description of these polyamines are included in the publication WO 00/15746 corresponding to U.S. patent application Ser. No. 09/786,938 filed Sep. 9, 1999 included herein by reference.

Further anionic scavengers which are suitable for use in the present invention are choline esters having the formula:

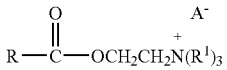

wherein R is a $C_8$–$C_{22}$ linear or branched, saturated or unsaturated hydrocarbyl unit, each $R^1$ unit is independently $C_1$–$C_{22}$ linear or branched hydrocarbyl, and mixtures thereof. In one embodiment each $R^1$ is methyl. The R unit, in one aspect of the present invention, is defined by the source of fatty acid which is used to form the choline ester, for example, soft tallow, hard tallow, canola, and the like. The anion A is any suitable anion unit.

Yet another aspect relates to polyvinyl amines having the formula:

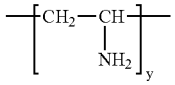

wherein the index y has a value such that the polyvinyl amine has an average molecular weight of from about 500 g/mol to about 5000 g/mol.

Any of the above anionic scavengers can be combined in any ratio or relative amounts to form a scavenging system.

Formulations

The present invention relates to rinse-added fabric enhancement compositions comprising:

a) from about 0.01% to about 20% by weight, of a cationic silicone polymer or copolymer as described herein:

b) from about 1% to about 30% by weight, of a scavenger effective in scavenging compounds comprising an anionic unit; and c) the balance a carrier system.

Other embodiments of the present invention include from 0.1% to about 5% by weight, of said cationic polymer while still another aspect relates to compositions comprising from 1% to about 10% by weight of said polymer. The formulator can use any amount of cationic polymer or copolymer within the ranges given herein and will adjust the amounts relative to the type of cationic scavenger which is chosen.

The anionic scavenger may be present in any effective amount, however, one aspect of the present invention relates to compositions that comprise from about 1% to about 30% by weight of said scavenger. Another aspect of the present invention relates to compositions wherein the anionic scavenger is present in an amount from about 2% to about 10% by weight. Suitable carriers are described in U.S. Pat. No. 6,083,899 Baker et al., issued Jul. 4, 2000; U.S. Pat. No. 6,211,140 Sivik et al., issued Apr. 3, 2001 both of which are include herein by reference.

Another embodiment of the present invention relates to a fabric rinse additive that comprises from about 0.01% to about 20%, by weight of a cationic silicone polymer and/or copolymer as described herein; optionally from about 1% to about 30% by weight of minors such as emulsifiers, perfumes, dyes, preservatives and other minor ingredients; and the balance a carrier system.

A process aspect of the present invention relates to a method for providing a fabric softening benefit in combination with an anti-wrinkle benefit such as wrinkle reduction, wrinkle prevention, ease of ironing, etc., without having to formulate the cationic silicone polymer and/or copolymer described herein into a fabric softening composition. The method comprises the step of contacting the fabric with both a fabric rinse additive composition and a separate fabric softening composition. Preferably, fabrics are contacted with the fabric rinse additive in at least two consecutive laundering cycles so as to achieve improved anti-wrinkle benefits.

The specific make up of the separate fabric softening composition is not critical provided the fabric softening composition would be effective in delivering fabric softening benefits to fabric in the absence of the fabric rinse additive composition. The fabric softening composition may comprise any conventional fabric softening active such as are described in WO 01/90285 published Nov. 29, 2001, which is incorporated herein by reference.

The fabric softening composition can be dispensed prior to, simultaneous with or following the dispensing of the fabric rinse additive composition. For instance, the fabric softening composition and fabric rinse additive compositions can be combined or mixed for subsequent dispensing into a rinse bath solution or can be dispensed separately. Dispensing of the compositions can be achieved through direct addition to the rinse bath, through one or more machine dispensers such as a dispensing drawer or agitator dispenser, or through one or more dispensers such as a DOWNY® Ball that would be placed in the washing machine with the fabrics for subsequent actuation and release of its contents by the action of the washing machine. Dispensing of the compositions can be also achieved through direct addition to a hand-rinse bath. Preferably, the fabrics are contacted with the separate fabric softening composition in the rinse prior to contacting with the silicone containing rinse additive in the rise water.

In a further embodiment, the present invention relates to the use of the fabric rinse additive composition in conjunction with a fabric softening composition to deliver both fabric softening and anti-wrinkle benefits to fabric. The fabric rinse additive composition can comprise the cationic silicone polymer and/or copolymer described herein or amine-functional siloxanes such as are described in U.S. Pat. No. 4,800,026, Coffindaffer et al. issued Jan. 24, 1989, and Can. Patent No. 1,102,511, Alkinson et al. issued Jun. 9, 1981, which are incorporated herein by reference. Other suitable silicones are polydimethylsiloxanes, alkyl-modified siloxanes, vinyl-modified siloxanes, polyalkylene oxide-modified siloxanes, amide-functional siloxanes and mixtures thereof. Preferably, the fabric rinse additive will comprise the cationic silicone polymers and/or copolymers described herein. In addition, it is preferred, that the fabric rinse additive composition be used in at least two consecutive laundering cycles so as to achieve improved anti-wrinkle benefits.

The following are non-limiting examples of compositions according to the present invention.

TABLE II

| | weight % | | | | |
|---|---|---|---|---|---|
| Ingredients | 4 | 5 | 6 | 7 | 8 |
| Anionic scavenger[1] | 21.0 | 21.0 | — | — | — |
| Anionic scavenger[2] | — | — | 19.0 | 24 | — |
| Anionic scavenger[3] | — | — | — | — | 6.0 |
| Ethanol[4] | 2.0 | 2.0 | 2.0 | 2.0 | 2.0 |
| Hexylene glycol[5] | 2.0 | 2.0 | 1.0 | 1.0 | 1.0 |
| Hexylene glycol[6] | 2.0 | 2.0 | — | 3.0 | 3.0 |
| Principal solvent[7] | 5.0 | — | — | — | — |
| Principal solvent[8] | — | 3.0 | — | — | — |
| Nonionic surfactant[9] | 4.5 | 3.0 | — | 2.0 | 2.0 |
| Cationic silicone[10] | 5.7 | — | — | — | — |
| Cationic silicone[11] | — | 5.7 | — | — | — |
| Cationic silicone[12] | — | — | 5.7 | 3.0 | 5.7 |
| Polyamine[13] | 1.0 | 1.0 | 1.0 | 1.0 | 1.0 |
| Solvent[14] | — | 3.0 | 3.0 | 2.0 | 3.0 |
| Calcium chloride | — | — | 1.5 | 2.2 | 1.4 |
| Magnesium chloride | 1.5 | 1.5 | — | — | — |
| Chelant[15] | — | — | 0.2 | 0.2 | 0.2 |
| Ammonium chloride | 0.1 | 0.1 | 0.3 | 0.5 | 0.3 |
| Perfume | 1.3 | 1.3 | 0.9 | 1.2 | 0.9 |
| Carriers | balance | balance | balance | balance | balance |

[1]N,N-di(canoyloxyethyl)-N-2-hydroxyethyl-N-methyl ammonium methyl sulfate available ex Witco.
[2]N,N-di(canolyl-oxy-ethyl)-N,N-dimethyl ammonium chloride.
[3]Ditallow dimethyl ammonium chloride.
[4]Ethanol is present from the manufacturing process of the quaternary fabric softener active.
[5]Hexylene glycol is present from the manufacturing process of the quaternary fabric softener active.
[6]Added hexylene glycol.
[7]2,2,4-Trimethyl-1,3-pentanediol.
[8]Cyclohexane, 1,4-dimethanol.
[9]$C_9$–$C_{11}$alkyl E8 alcohol available as Neodol ® 91-8 ex Shell.
[10]Tubingal 3474, alkylated cationic silicone ex CHT Beitlich.
[11]Cationic polymer according to examples described in Table I, No. 7 where m = 4, n = 82, a + c = 3 and b = 9.
[12]Cationic polymer according to examples described in Table I, No. 17 where m = 4, n = 160, a + c = 3 and b = 9.
[13]1,1-N-dimethyl-9,9-N"-dimethyl dipropylenetriamine.
[14]Isopropanol.
[15]Tetrakis-(2-hydroxypropyl)ethylenediamine.

TABLE III

| Ingredients | weight % 9 | 10 | 11 | 12 |
|---|---|---|---|---|
| Anionic scavenger[1] | 52.5 | — | — | 55.0 |
| Anionic scavenger[2] | — | 37.7 | — | — |
| Anionic scavenger[3] | — | — | 8.0 | — |
| Ethanol[4] | 4.0 | 6.6 | 5.0 | 4.0 |
| Hexylene glycol[5] | 4.6 | — | — | 1.2 |
| Hexylene glycol[6] | 2.0 | 10.2 | — | — |
| Principal solvent[7] | 8.75 | — | — | — |
| Nonionic surfactant[8] | 8.75 | 8.75 | — | 8.75 |
| Cationic silicone[9] | — | 14.25 | — | — |
| Cationic silicone[10] | 14.25 | — | 6.0 | 10.0 |
| Polyamine[11] | 1.0 | 1.0 | — | — |
| Solvent[12] | 1.3 | 10.2 | — | — |
| Solvent[13] | 1.3 | 10.2 | — | — |
| Calcium chloride | — | — | 0.5 | — |
| Chelant[14] | — | — | 0.2 | — |
| Perfume | 1.3 | 1.3 | 0.9 | 1.3 |
| Carriers | balance | balance | balance | balance |

[1]N,N-di(canoyloxyethyl)-N-2-hydroxyethyl-N-methyl ammonium methyl sulfate available ex Witco.
[2]N,N-di(canolyl-oxy-ethyl)-N,N-dimethyl ammonium chloride.
[3]N,N-di(tallowyl-oxy-ethyl)-N-N-dimethyl ammonium chloride.
[4]Ethanol is present from the manufacturing process of the quaternary fabric softener active.
[5]Hexylene glycol is present from the manufacturing process of the quaternary fabric softener active.
[6]Added hexylene glycol.
[7]Cyclohexane, 1,4-dimethanol.
[8]$C_9$–$C_{11}$ alkyl E8 alcohol available as Neodol ® 91-8 ex Shell.
[9]Tubingal 3474, alkylated cationic silicone ex CHT Beitlich.
[10]Cationic polymer according to examples described in Table I, No. 7 where m = 4, n = 82, a + c = 3 and b = 9.
[11]1,1-N-dimethyl-9,9-N"-dimethyl dipropylenetriamine.
[12]Isopropanol.
[13]Glycerin,
[14]Tetrakis-(2-hydroxypropyl)ethylenediamine.

In the above examples, the cationic silicone can be pre-mixed with an emulsifier, for example, an nonionic surfactant such as a Tergitol® prior to admixture with the balance of the ingredients.

The following are non-limiting examples of the rinse additive compositions according to the present invention.

TABLE IV

| Ingredients | weight % 13 | 14 | 15 | 16 |
|---|---|---|---|---|
| Cationic surfactant[1] | — | — | — | 3.5 |
| Nonionic surfactant[2] | 2.00 | — | — | 1.5 |
| Nonionic surfactant[3] | — | 3.2 | 8.75 | — |
| Cationic silicone[4] | — | 6.0 | 10.0 | — |
| Aminosilicone[5] | — | — | — | 11.0 |
| Aminosilicone[6] | 5.25 | — | — | — |
| Calcium chloride | — | 0.5 | — | — |
| Chelant[7] | 0.2 | 0.2 | — | — |
| Hydrochloric acid | 0.15 | — | — | — |
| Acetic acid | — | 0.20 | 0.20 | 0.35 |
| Perfume | 1.3 | 0.9 | 1.3 | 1.3 |
| Carriers | balance | balance | balance | balance |

[1]$C_{16}$ alkyltrimethylammonium chloride
[2]$C_{11}$–$C_{14}$ branched alcohols, $C_{13}$-rich, ethoxylated
[3]$C_9$–$C_{11}$ alkyl E8 alcohol available as Neodol ® 91-8 ex Shell.
[4]Cationic polymer according to Example 3.
[5]Amino functional silicone fluid TSF4708 ex GE-Silicones.
[6]DOW CORNING ® 2-8566 ex Dow Corning.
[7]Tetrakis-(2-hydroxypropyl)ethylenediamine.

What is claimed is:

1. A method of providing a fabric softening and anti-wrinkling benefit to fabrics during a laundry cycle, the method comprising the steps of:

(a) contacting the fabric, during a rinse cycle, with a fabric softening composition comprising an effective amount of an anionic scavenger selected from the group consisting of:

i) tertiary amine having the formula:

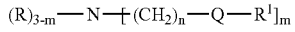

or quaternary amine having the formula:

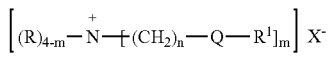

wherein each R is independently selected from the group consisting of: $C_1$–$C_6$ alkyl, $C_1$–$C_6$ hydroxyalkyl, benzyl, and mixtures thereof;

each $R^1$ is independently selected from the group consisting of: $C_{11}$—$C_{22}$ linear alkyl, $C_{11}$–$C_{22}$ branched alkyl, $C_{11}$–$C_{22}$ linear alkenyl, $C_{11}$–$C_{22}$ branched alkenyl, and mixtures thereof;

Q is a carbonyl moiety independently selected from the units having the formula:

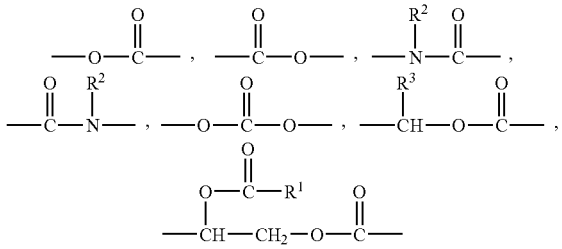

wherein $R^2$ is hydrogen or $C_1$–$C_4$ alkyl; $R^3$ is $C_1$–$C_4$ alkyl;

X is an anion selected from the group consisting of: chloride, bromide, methylsulfate, ethylsulfate, sulfate, nitrate, and mixtures thereof;

m is from 1 to 3;

n is from 1 to 4;

ii) quaternary amine having the formula:

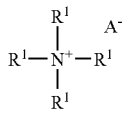

wherein each $R^1$ is independently selected from the group consisting of: $C_1$–$C_{22}$ linear or branched alkyl, $C_2$–$C_{22}$ linear or branched alkenyl, and mixtures thereof; A is a water soluble counter ion; and (b) contacting the fabric with a fabric rinse composition comprising from about 0.01% to about 20% by weight of the composition, of a fabric rinse additive, which is a cationic silicone polymer or copolymer having the formula:

$$[CAP]\text{-}Z_m\text{-}[CAP]$$

wherein [CAP] is a backbone termination unit;

m is from 1 to 50; each Z unit independently has the formula:

$$—R—W—R_x—$$

x is 0 or 1;

W is a siloxane unit having the formula:

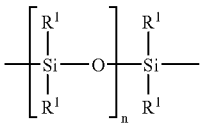

each $R^1$ unit is a $C_1$–$C_{22}$ linear or branched, substituted or unsubstituted hydrocarbyl moiety; n is from 1 to 500;

R is a nitrogen atom containing backbone unit having the formula:

$$\text{-}[(L)_y\text{-}(R^2)_y\text{-}(L)_y]\text{-}B\text{-}[(L)_y\text{-}(R^2)_y\text{-}(L)_y]$$

B is a unit comprising at least one secondary, tertiary, or quaternary amino moiety, or mixtures thereof; L is a linking unit; y is 0 or 1;

$R^2$ is a coupling unit having the formula:

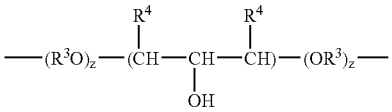

$R^3$ is $C_2$–$C_{12}$ linear or branched alkylene; $R^4$ is hydrogen, or a $C_1$–$C_{22}$ linear or branched, substituted or unsubstituted hydrocarbyl moiety; z is from 0 to 50;

wherein B is selected from the group consisting of:

i)

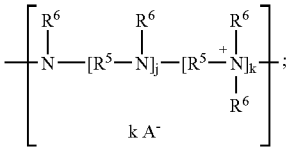

ii)

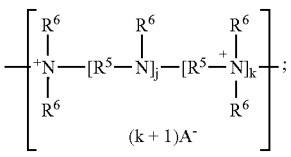

iii) mixtures thereof wherein each $R^5$ is independently:

i) $C_2$–$C_{12}$ linear or branched alkylene;

ii) $C_6$–$C_{12}$ arylene;

iii) $C_7$–$C_{22}$ alkylenearylene;

iv) an alkyleneoxy unit having the formula:

$$—(R^{11}O)_a(R^{11}O)_b(R^{11}O)_c(R^{11})—$$

wherein $R^{11}$ is a $C_2$–$C_{12}$ alkylene unit, the indices a, b, and c are from 0 to 100;

v) a linking unit derived from a dibasic acid, glycidyl ether, or mixtures thereof having the formula:

$$—[C(O)]_d(R^{11}O)_a(R^{12})_e[C(O)]_d—$$

wherein $R^{12}$ is $C_1$–$C_{20}$ linear or branched alkylene; $—CH_2CHOHCH_2—$, and mixtures thereof, a is from 0 to 100, d is 0 or 1, e is from 0 to 20;

each $R^6$ is independently:

i) hydrogen;

ii) $C_1$–$C_{22}$ linear or branched, substituted or unsubstituted hydrocarbyl moiety;

iii) two $R^6$ units from the same nitrogen atom can be taken together to form an aromatic or non-aromatic, quaternized or non-quaternized heterocyclic unit;

iv) two $R^6$ units each from adjacent nitrogen atoms can be taken together to form an aromatic or non-aromatic, quaternized or non-quaternized heterocyclic unit;

v) one $R^6$ unit can be taken together with a $R^5$ unit to form an aromatic or non-aromatic, quaternized or non-quaternized heterocyclic unit;

vi) and mixtures thereof;

A is a water soluble anion; j is from 0 to 6, k is from 0 to 1.

L is selected from the group consisting of:

i) $—[C(R^7)_2]_p—$; wherein p is from 1 to 22;

ii) $—[C(R^7)_2]_p(CH{=}CH)_q—$; wherein p is from 0 to 12; q is from 1 to 6;

iii) —C(X)—;

iv) —OC(X)—;

v) —C(X)O—;

vi) $—[C(R^7)_2]_qC(X)X(R^8O)_p—$; wherein p is from 0 to 12; q is from 1 to 6;

vii) $—(OR^8)_pXC(X)[C(R^7)_2]_q—$; wherein p is from 0 to 12; q is from 1 to 6;

viii) $—C(X)R^8C(X)—$;

ix) $—OR^8—$;

x) $—R^8O—$;

xi) $—(R^8)_uC(X)(R^8)_u—$;

xii) $—(R^8)_uOC(O)(R^8)_u—$;

xiiii) $—(R^8)_uC(O)O(R^8)_u—$;

xiv) $—(R^8)_uOC(O)O(R^8)_u—$;

wherein $R^7$ is hydrogen, $C_1$–$C_{22}$ linear or branched alkyl; $C_1$–$C_{22}$ cycloalkyl; $C_1$–$C_{22}$ linear or branched fluoroalkyl; $C_2$–$C_{22}$ linear or branched alkenyl; $C_6$–$C_{22}$ aryl; $C_7$–$C_{22}$ alkylenearyl; and mixtures thereof; $R^8$ is $C_2$–$C_{20}$ linear or branched, substituted or unsubstituted alkylene; $C_7$–$C_{20}$ alkylenearylene; $C_6$–$C_{20}$ substituted or unsubstituted arylene; and mixtures thereof; X is oxygen, sulfur, $=NR^7$, and mixtures thereof; u is 0 or 1;

[CAP] is selected from the group consisting of:

i)

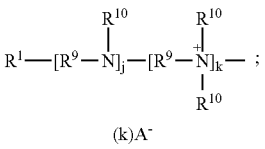

-continued ii)

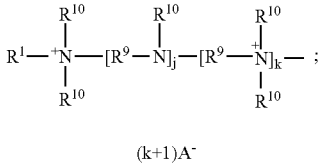

iii)

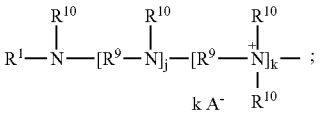

iv)

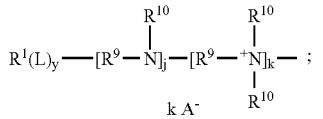

v)

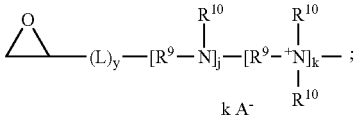

vi)

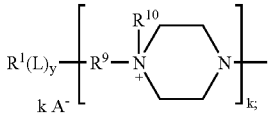

vii) mixtures thereof;

wherein each $R^9$ is independently $C_1$–$C_{12}$ linear or branched alkylene, $C_6$–$C_{12}$ arylene, $C_7$–$C_{22}$ alkylene-arylene; $R^{10}$ is hydrogen, or a $C_1$–$C_{22}$ linear or branched, substituted or unsubstituted hydrocarbyl moiety; two $R^{10}$ units from the same nitrogen atom, two $R^{10}$ units each from adjacent nitrogen atoms, or one $R^{10}$ unit can be taken together with a $R^5$ unit or a $R^1$ unit to form an aromatic or non-aromatic, quaternized or non-quaternized heterocyclic unit, and mixtures thereof; $R^1$ and $R^5$ are the same as defined herein above; A is a water soluble anion; j is from 0 to 6, k is from 0 to 1, wherein the fabric is contacted with the fabric rinse additive in at least two consecutive laundry cycles.

2. The method of claim 1, wherein step a) precedes step b).

3. A method of providing improved anti-wrinkle benefit to fabrics during a laundering cycle, the method comprising the step of contacting the fabrics with a composition in at least two consecutive laundry cycles, said composition comprising:

a) from about 0.01% to about 20% by weight of the composition, of a cationic silicone polymer or copolymer having the formula:

$$[CAP]\text{-}Z_m\text{-}[CAP]$$

wherein wherein [CAP] is a backbone termination unit; m is from 1 to 50; each Z unit independently has the formula:

$$—R—W—R_x—$$

x is 0 or 1;

W is a siloxane unit having the formula:

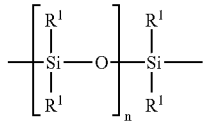

each $R^1$ unit is a $C_1$–$C_{22}$ linear or branched, substituted or unsubstituted hydrocarbyl moiety; n is from 1 to 500;

R is a nitrogen atom containing backbone unit having the formula:

$$\text{-}[(L)_y\text{-}(R^2)_y\text{-}(L)_y]\text{-}B\text{-}[(L)_y\text{-}(R^2)_y\text{-}(L)_y]\text{-}$$

B is a unit comprising at least one secondary, tertiary, or quatemary amino moiety, or mixtures thereof; L is a linking unit; y is 0 or 1;

$R^2$ is a coupling unit having the formula:

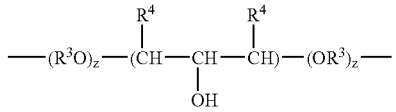

$R^3$ is $C_2$–$C_{12}$ linear or branched alkylene; $R^4$ is hydrogen, or a $C_1$–$C_{22}$ linear or branched, substituted or unsubstituted hydrocarbyl moiety; z is from 0 to 50;

wherein B is selected from the group consisting of:

i)

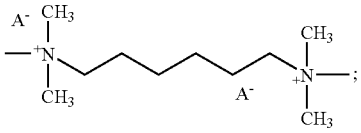

ii)

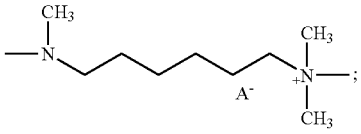

iii)

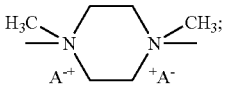

iv)

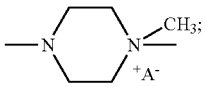

v)

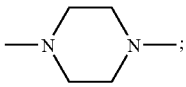

vi)

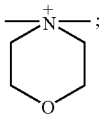

vii) and mixtures thereof;

A is a water soluble anion:

L is selected from the group consisting of:

i) —$[C(R^7)_2]_p$—; wherein p is from 1 to 22;

ii) —$[C(R^7)_2]_p(CH{=}CH)_q$—; wherein p is from 0 to 12; q is from 1 to 6;

iii) —C(X)—;

iv) —OC(X)—;

v) —C(X)O—;

vi) —$[C(R^7)_2]_qC(X)X(R^8O)_p$—; wherein p is from 0 to 12; q is from 1 to 6;

vii) —$(OR^8)_pXC(X)[C(R^7)_2]_q$—; wherein p is from 0 to 12; q is from 1 to 6;

viii) —$C(X)R^8C(X)$—;

ix) —$OR^8$—;

xi-) —$R^8O$—;

xi-i) —$(R^8)_uC(X)(R^8)_u$—;

xii-i) —$(R^8)_uOC(O)(R^8)_u$—;

xiii) —$(R^8)_uC(O)O(R^8)_u$—;

xiv) —$(R^8)_uOC(O)O(R^8)_u$—;

wherein $R^7$ is hydrogen, $C_1$–$C_{22}$ linear or branched alkyl; $C_1$–$C_{22}$ cycloalkyl; $C_1$–$C_{22}$ linear or branched fluoroalkyl; $C_2$–$C_{22}$ linear or branched alkenyl; $C_6$–$C_{22}$ aryl; $C_7$–$C_{22}$ alkylenearyl; and mixtures thereof; $R^8$ is $C_2$–$C_{20}$ linear or branched, substituted or unsubstituted alkylene; $C_7$–$C_{20}$ alkylenearylene; $C_6$–$C_{20}$ substituted or unsubstituted arylene; and mixtures thereof; X is oxygen, sulfur, $=NR^7$, and mixtures thereof; u is 0 or 1;

[CAP] is selected from the group consisting of:

i)

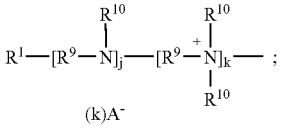

ii)

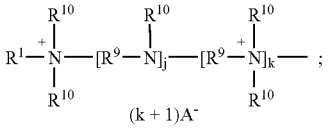

-continued iii)

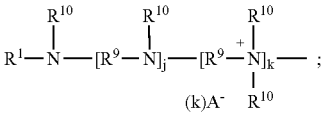

iv)

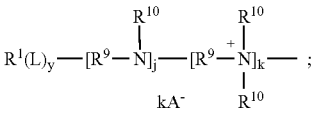

v)

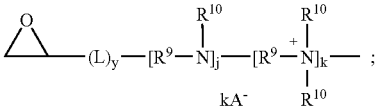

vi)

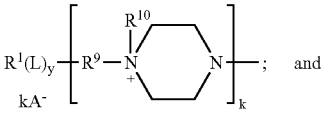

vii) mixtures thereof;

wherein each $R^9$ is independently $C_1$–$C_{12}$ linear or branched alkylene, $C_6$–$C_{12}$ arylene, $C_7$–$C_{22}$ alkylenearylene; $R^{10}$ is hydrogen, or a $C_1$–$C_{22}$ linear or branched, substituted or unsubstituted hydrocarbyl moiety; two $R^{10}$ units from the same nitrogen atom, two $R^{10}$ units each from adjacent nitrogen atoms, or one $R^{10}$ unit can be taken together with a $R^5$ unit or a $R^1$ unit to form an aromatic or non-aromatic, quaternized or non-quaternized heterocyclic unit, and mixtures thereof; $R^1$ and $R^5$ are the same as defined herein above; A is a water soluble anion; j is from 0 to 6, k is from 0 to 1; and (b) a carrier system.

* * * * *